United States Patent [19]

Tornare et al.

[11] Patent Number: 4,639,197

[45] Date of Patent: Jan. 27, 1987

[54] PUMP FOR CRYOGENIC FLUIDS

[76] Inventors: Jean Tornare, Hauptstrasse 49, CH 4422 Arisdorf/BL; Klaus Bofinger, Fuchsmattstrasse 13, CH 4107 Ettingen; Claudio Tschopp, Lachmattstrasse 21, CH 4132 Muttenz, all of Switzerland

[21] Appl. No.: 697,756

[22] Filed: Feb. 4, 1985

[30] Foreign Application Priority Data

Jul. 20, 1984 [CH] Switzerland ..... 3535/84

[51] Int. Cl.[4] ..... F04B 3/00; F04B 15/08

[52] U.S. Cl. ..... 417/259; 417/901

[58] Field of Search ..... 417/259, 262, 548, 901; 62/55; 92/144

[56] References Cited

U.S. PATENT DOCUMENTS

| | | | |
|---|---|---|---|
| 236,992 | 1/1881 | Cushier | 417/262 |
| 464,223 | 12/1891 | Fasoldt | 417/259 |
| 792,790 | 6/1905 | Prellwitz | 417/262 |
| 2,447,741 | 8/1948 | De Baufre | 417/901 |
| 2,696,785 | 12/1954 | Blue | 62/55 |
| 2,837,898 | 6/1958 | Ahlstrand | 417/549 |
| 2,931,313 | 4/1960 | Hughes | 417/901 |
| 3,136,136 | 6/1964 | Goltzmann | 417/901 |
| 3,145,629 | 8/1964 | Goltzmann | 92/144 |
| 3,160,105 | 12/1964 | Sherman et al. | 417/262 |
| 3,220,202 | 11/1965 | Goltzmann | 417/901 |
| 3,379,132 | 4/1968 | Wagner | 62/55 |
| 3,495,544 | 2/1970 | Enssle | 92/248 |
| 4,239,460 | 12/1980 | Golz | 417/901 |
| 4,447,195 | 5/1984 | Schuck | 417/901 |

*Primary Examiner*—William L. Freeh
*Assistant Examiner*—Paul F. Neils
*Attorney, Agent, or Firm*—Tilton, Fallon, Lungmus & Chestnut

[57] ABSTRACT

The cryogenic pump operates in two stages, utilizing a supercharging part and a high pressure part. These two parts are comprised of a high pressure piston pump (3, 4, 34, 35) and a supercharger (5, 6, 61, 62) disposed in a tandem relationship and sharing a common piston rod (8). The supercharger is enclosed in a heat insulated intermediate container (7) and delivers the liquid cryogenic fluid to the high pressure cylinder. The pump operates to convey a liquid cryogenic fluid such as liquid nitrogen, for example, at a high pressure through evaporating means into pressure resistant commercial steel cylinders where the gaseous nitrogen is kept at a pressure of 200 bar and ambient temperature.

6 Claims, 1 Drawing Figure

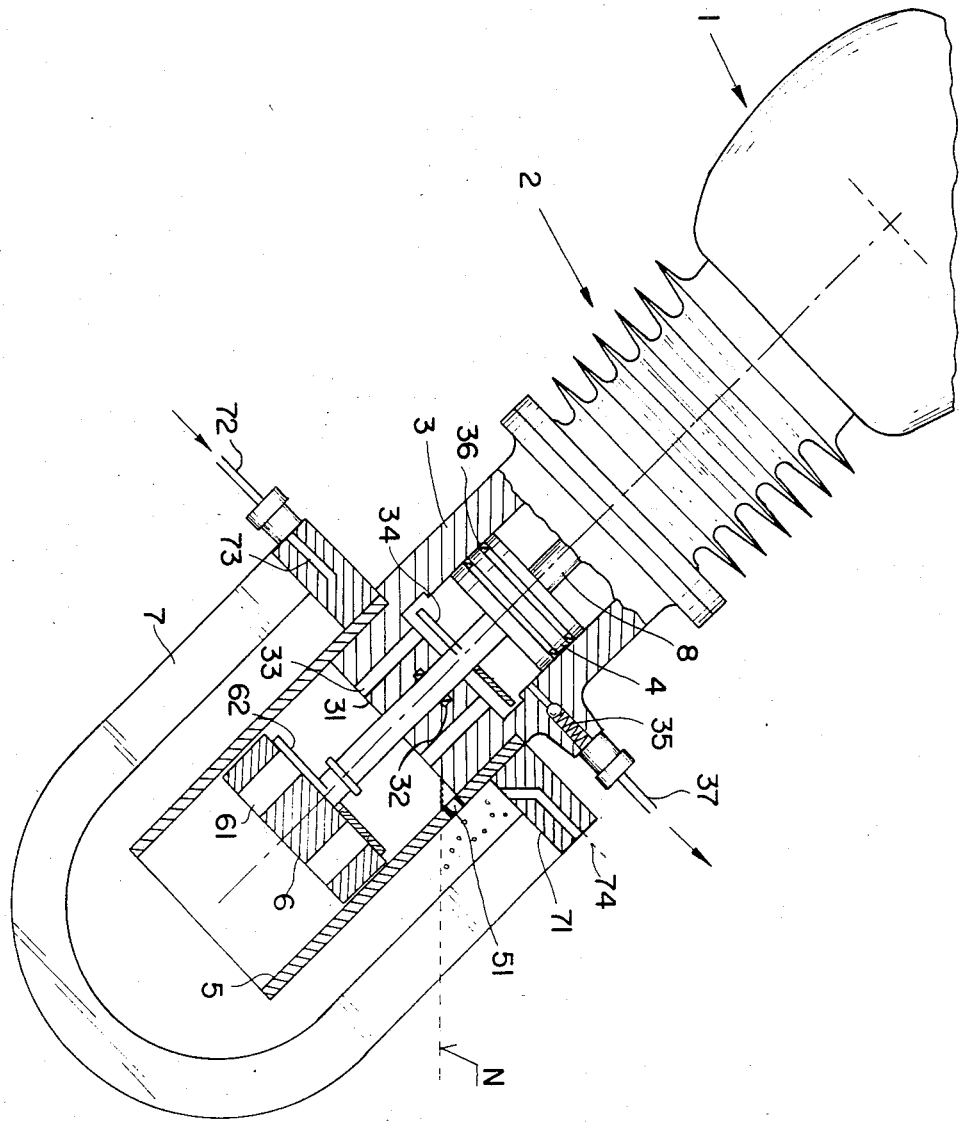
1
2
3
36
34
72
73
7
33
62
31
32
61
6
5
8
4
35
37
74
71
51
N

PUMP FOR CRYOGENIC FLUIDS

BACKGROUND AND SUMMARY OF INVENTION

The invention concerns a pump for cryogenic fluids. Such pumps are used when pressure resistant commercial steel cylinders are to be filled with gas, such as for example nitrogen at high pressure.

Nitrogen is produced from liquified air under low temperature. It is stored in an insulated storage tank at a temperature of approximately −196° C. and under low vapor pressure of approximately 2 bar.

It is put on the market however in high pressure steel bottles in which the nitrogen is in gaseous condition at room temperature and under a pressure of approximately 200 bar.

The cryogenic pump has the task of pumping the liquid nitrogen from the storage tank and raising its pressure to about 200 bar, so that after evaporation it can be placed into the high pressure steel bottles.

In the pumping of cryogenic fluids, special difficulties are encountered due to the fact that the fluid converts from the liquid to the gaseous phase by a decrease in pressure as well as by a rise of temperature. At the beginning the pump is at atmospheric pressure and room temperature and must be cooled down to approximately the temperature of the cryogenic fluid. During operation, the conditions must be brought to over and above the conditions of the vapor pressure curve of the cryogenic fluid being pumped. This is because on the suction stroke of the pump the pressure decreases, giving rise to gas formation.

Known measures to avoid such problems include the following:

1. Conveying the fluid from the large storage tank in which vapor pressure conditions prevail into a closed intermediate container which is heat insulated to the best possible extent, and lowering the temperature below the temperature of the vapor pressure.

2. Increasing the pressure in the intermediate container above the vapor pressure.

To implement the last mentioned measure, a pump is disclosed in Swiss Patent Specification No. CH-PS 615,982 which has a stepped or differential piston, a hollow piston rod and valves disposed in the piston. The high degree of compression gives rise to corresponding gas forming currents which must be conveyed by means of an elaborate valve system out of the low pressure part. Pumps of this type are complicate and expensive to manufacture.

It is the object of the present invention to create a pump as recited in claim 1, which pump operates according to this principle, but which is structurally less complex and more cost efficient to manufacture and which causes a lesser degree of gas formation during the precompression phase.

This is accomplished according to the invention by providing a cryogenic pump which incorporates the specific features recited in claim 1.

DETAILED DESCRIPTION

The drawing illustrates one embodiment of the invention. It shows a cryogenic pump in a simplified representation, the drive mechanism being shown in a side view and the pump proper in a sectional view. The pump comprises a high pressure part and a supercharger part which are disposed in tendem.

The main components of the pump are: a crankcase 1, a ribbed intermediate body section 2, the high pressure pump cylinder 3 including a piston 4, and the supercharger cylinder 5 including a piston 6. The supercharger cylinder including its piston are disposed in a double-walled intermediate container 7. The two pistons 4 and 6 are mounted on a common piston rod 8 which extends through the bottom 31 of the high pressure cylinder and is sealed off by sealing means 32. Thus, the bottom serves as a partition between the two parts.

The bottom of the high pressure cylinder is provided with intake openings 33. During the compression stroke, these openings 33 are closed by an annular plate valve 34. The discharge opening of the high pressure cylinder is regulated by a spring-loaded ball valve 35. The high pressure piston 4 is sealed off by annular sealing means 36.

The supercharger 5 takes the form of a pipe open at the intake side and having an opening 51 at its highest point. The supercharger piston 6 is provided with some bores 61 which are closed during the compression or charging stroke by an annular plate valve 62. The piston rod 8 is provided with an abutment for the plate valve 62.

The double-walled intermediate container 7, which is constructed like a Dewar vessel, is connected to the cylinder 5 by means of a flange 71. The fluid is conveyed into the container 7 by a supply line 72 extending through a hole 73 in the flange 71. Also provided in the flange 71 is an opening 74, indicated in the drawing by a dash-dotted line. The openihg 74 is adapted to be closed and serves to momentarily let off gas.

The drawing illustrates the pump in a position inclined at 45° relative to the vertical. This is an operative position, and the opening 51 in the supercharger is at the highest point. Instead of in an inclined position, the pump is operable also in the horizontal position. This is of special importance because then the gases inevitably forming from the fluid, though being held to a minimum, will rise and accumulate there, so that the supercharger piston 6 is able to almost exclusively deliver liquid fluid to the high pressure piston.

Furthermore, the displacement volume of the supercharger is greater than that of the high pressure pump so that fluid in its liquid phase is also discharged there. As will be noted from the foregoing discussion, the supercharger piston 6 is not sealed off by sealing means from the cylinder 5, but there is some clearance relative to the inside wall of the cylinder, thus providing an additional escape route for any excess fluid pumped in order to prevent the occurrence of unnecessary internal friction which would lead to gas formation.

In the drawing, the pump is illustrated in the condition it is in as a suction stroke is in progress during which the piston rod 8 with the pistons 4 and 6 thereon moves obliquely upward. Consequently, the apertures in the piston 6 are closed by the valve plate 62 and the apertures 33 are opened by the valve plate 34. The intermediate container 7 is filled with liquid fluid up to the level N. Above this level, the fluid is in the gaseous phase indicated in the drawing by small gas bubbles. As it will be apparent, the high pressure cylinder is filled by the supercharger piston almost exclusively with liquid fluid. At the end of the suction stroke, the motion is reversed and the high pressure cylinder moves downwards. Due to the increased pressure, any gaseous portion is recondensed to the liquid phase, so that liquid fluid is pressed into the high pressure conduit 37.

The closable aperture 74 serves as an outlet for the gas, particularly during the initial stage as long as the various parts of the pump have not cooled off sufficiently yet to closely approach the low temperature of the fluid so that a great volume of gas is being formed. The high pressure cylinder would merely compress the gas but would not convey any liquid fluid.

When using the pump for pumping liquid nitrogen, for example, the nitrogen in the insulated storage tank (not shown) has a temperature of −196° C. and is subject to a pressure of approximately 2 bar. The liquid nitrogen is conveyed out of a large storage tank through the conduit 72 to the pump which pumps the liquid nitrogen to a high pressure of approximately 200 bar. Thereupon, the nitrogen is passed through evaporation means and in its gaseous state is filled at amblent temperatures into pressure resistant steel cylinders. In these cylinders, the nitrogen is stored at a pressure of 200 bar. The cylinders so filled are then shipped to the final consumer.

We claim:

1. Pump for cryogenic fluids, having a high pressure part and a supercharger part, the high pressure part and the supercharger part each comprising a piston pump (3,4) (5,6) disposed in tandem and separated from one another by a partition (31) the pistons having a common piston rod (8) which slidably and sealingly extends through said partition, said partition being provided with an intake valve (33,34) the supercharger part being disposed in a heat insulated intermediate fluid container in sealing relationship with said partition, providing a sump for said supercharger part, said supercharger part comprising a cylinder (5) open at the intake side and a piston (6) provided with an intake valve (61,62) the supercharger cylinder (5) having a larger inside diameter than the high pressure cylinder (3), volume equilibrium being attained by an opening (51) provided at the highest point of said supercharger - cylinder, said opening emptying into the intermediate fluid container (7).

2. The pump according to claim 1 in which said partion (31) is provided with inlet openings (33) covered by an annular valve plate (34).

3. The pump according to claim 1 in which said supercharger piston (6) is provided with inlet openings (61) covered by an annular valve plate (62).

4. The pump according to claim 1 in which said intermediate container (7) having an inlet duct (72) is connected to a storage tank.

5. The pump according to claim 1 in which said high pressure cylinder has a spring loaded ball valve (35) leading to a high pressure duct (37).

6. The pump according to claim 1 in which said intermediate container (7) is provided at its highest point, when it is in an operative position with a closable gs discharge opening (74).

* * * * *